US007918917B2

(12) United States Patent
Nakakado et al.

(10) Patent No.: US 7,918,917 B2
(45) Date of Patent: Apr. 5, 2011

(54) METHOD OF SMELTING COPPER

(75) Inventors: Kenta Nakakado, Tamano (JP); Makoto Hamamoto, Tamano (JP); Seiichi Watanabe, Tamano (JP)

(73) Assignee: Pan Pacific Copper Co., Ltd., Tokyo (JP)

( * ) Notice: Subject to any disclaimer, the term of this patent is extended or adjusted under 35 U.S.C. 154(b) by 0 days.

(21) Appl. No.: 12/502,710

(22) Filed: Jul. 14, 2009

(65) Prior Publication Data

US 2010/0050811 A1 Mar. 4, 2010

(30) Foreign Application Priority Data

Sep. 4, 2008 (JP) ..... 2008-227127

(51) Int. Cl.
*C22B 15/06* (2006.01)
*C22B 15/14* (2006.01)

(52) U.S. Cl. ..... 75/640; 75/10.35

(58) Field of Classification Search ..... 75/640, 75/10.35

See application file for complete search history.

(56) References Cited

U.S. PATENT DOCUMENTS

| | | | | |
|---|---|---|---|---|
| 4,006,010 | A * | 2/1977 | Rajcevic et al. | 75/10.35 |
| 4,144,055 | A * | 3/1979 | Petersson et al. | 75/10.35 |
| 6,761,749 | B1 * | 7/2004 | Poijarvi et al. | 75/10.35 |

FOREIGN PATENT DOCUMENTS

| | | | |
|---|---|---|---|
| JP | 57-41333 | A | 3/1982 |
| JP | 57-192232 | A | 11/1982 |
| JP | 11-21835 | A | 1/1999 |
| JP | 2003-213347 | A | 7/2003 |

OTHER PUBLICATIONS

Kojo et al., "Outokumpu Blister Smelting Processes-Clean Technology Standards", Cu2007, The proceddings of the Carlos Diaz Symposium on Pyrometallurgy, Toronto, Canada, 2007, vol. 3, Book 2, pp. 183-190.

Tuominen et al., "Slag Cleaning of Outokumpu Direct-To-Blister Flash Smelting Slags", Cu2007, The proceedings of the Carlos Diaz Symposium on Pyrometallurgy, Toronto, Canada, 2007, vol. 3, Book 2, pp. 339-350.

Office Action dated Aug. 3, 2010 issued in corresponding Japanese patent application No. 2008-227127 (with English translation).

* cited by examiner

*Primary Examiner* — George Wyszomierski
*Assistant Examiner* — Tima M McGuthry-Banks
(74) *Attorney, Agent, or Firm* — Birch, Stewart, Kolasch & Birch, LLP

(57) ABSTRACT

A method of smelting copper includes: a generating step of generating blister and calcium ferrite slag from copper matte by charging the copper matte into a smelting furnace and oxidizing the copper matte; and a refining step of refining another blister from the calcium ferrite slag in an electrical furnace under a temperature condition of 1250 degrees C. to 1350 degrees C. and under a reductive atmosphere condition of oxygen partial pressure $\log PO_2 \leqq -9.3$.

20 Claims, 1 Drawing Sheet

METHOD OF SMELTING COPPER

BACKGROUND OF THE INVENTION

1. Field of the Invention

The present invention relates a method of smelting copper.

2. Description of the Related Art

I. V. Kojo and M. Lahtinen, "Outokumpu blister smelting processes, clean technology standards": Cu2007, The proceedings of the Carlos Diaz symposium on Pyrometallurgy, Vol. 3, Book 2, (Toronto, Canada, 2007), pp. 183-190 discloses a method using a flash converter furnace as a copper smelting method not using a P.S. converter furnace. Japanese Patent Application Publication No.2003-213347 discloses MI continuous copper smelting method as a copper smelting method not using a P.S. converter furnace.

In the method using the flash converter furnace, prepared and dried copper concentrate is charged into a flash smelting furnace, the copper concentrate is dissolved and divided into copper matte and slag, the matte is crushed and charged into the flash converter furnace after cooling, the charged matte is divided into blister and calcium ferrite slag through oxidation of the charged matte, and anode is cast by oxidizing and reducing the blister in a refining furnace.

In the MI continuous copper smelting method, prepared and dried copper concentrate is charged into a "S" furnace, the copper concentrate is dissolved and divided into copper matte and slag, the matte is charged into a "C" furnace, the charged matte is divided into blister and calcium ferrite slag through oxidation of the charged matte, and anode is cast by oxidizing and reducing the blister in a refining furnace.

The matte is collected and separated from the slag generated in the flash smelting furnace or the "S" furnace by retaining the slag in a slag cleaning furnace or a CL furnace. The separated matte is charged into the flash converter furnace or the "C" furnace. The slag is sold after water granulating. The calcium ferrite slag generated in the flash converter furnace or the "C" furnace is repeated to the flash smelting furnace or the "S" furnace and the "C" furnace after water granulating.

The calcium ferrite slag generated in the flash converter furnace or the "C" furnace includes approximately 20% of copper. The calcium ferrite slag may be used as steel raw material, if copper grade of the calcium ferrite slag is reduced.

However, the calcium ferrite slag has electrical conductivity higher than silicate slag. Therefore, it has been thought difficult to keep the dissolved calcium ferrite slag stable compared to the silicate slag, in a conventional electrical furnace using heat caused by electrical resistance. This results in repetition of the calcium ferrite slag to the flash smelting furnace or the "S" furnace and the "C" furnace after water granulating.

SUMMARY OF THE INVENTION

The present invention has been made in view of the above circumstances and provides a method of smelting copper that may obtain blister copper from calcium ferrite slag without repetition of the calcium ferrite slag generated in a smelting furnace.

According to an aspect of the present invention, there is provided a method of smelting copper including: a generating step of generating blister and calcium ferrite slag from copper matte by charging the copper matte into a smelting furnace and oxidizing the copper matte; and a refining step of refining another blister from the calcium ferrite slag in an electrical furnace under a temperature condition of 1250 degrees C. to 1350 degrees C. and under a reductive atmosphere condition of oxygen partial pressure $\log PO_2 \leqq -9.3$. With the method, blister copper may be obtained from calcium ferrite slag without repetition of the calcium ferrite slag generated in a smelting furnace.

Copper grade of the calcium ferrite slag may be reduced to 0.8 weight % or less by controlling reductive degree in the electrical furnace, in the refining step. In this case, obtained calcium ferrite slag may be used as steel raw material.

Iron grade of the calcium ferrite slag may be increased to 55 weight % or more by controlling reductive degree in the electrical furnace, in the refining step. In this case, obtained calcium ferrite slag may be used as steel raw material.

Copper grade of the copper matte before being charged into the smelting furnace may be 65 weight % to 75 weight %. Calcium ferrite slag having copper grade of 10 weight % to 25 weight % and including 10 weight % to 20 weight % calcium oxide may be generated in the generating step.

The electrical furnace may be a resistance heating electrical furnace. Slag needs specific resistance in the resistance heating electrical furnace. Reduction process increases the specific resistance of calcium ferrite slag. Therefore, an electrical furnace for silicate slag may be used as a furnace for the reduction process of the calcium ferrite slag.

The calcium ferrite slag may be reduced by charging reductant into the electrical furnace in the refining step. The reductant may include at least one of coke, iron grain, and pig iron grain.

The smelting furnace may be a flash converter furnace or a continuous copper smelting furnace. In this case, an existing smelting furnace may be used. It is therefore possible to reduce cost.

A slag cleaning furnace of a flash smelting furnace may be used as the electrical furnace. In this case, an existing slag cleaning furnace may be used. It is therefore possible to reduce cost.

BRIEF DESCRIPTION OF THE DRAWINGS

Other objects, features and advantages of the present invention will become more apparent from the following detailed description when read in conjunction with the accompanying drawings, in which.

DESCRIPTION OF THE PREFERRED EMBODIMENTS

Figure 1A:
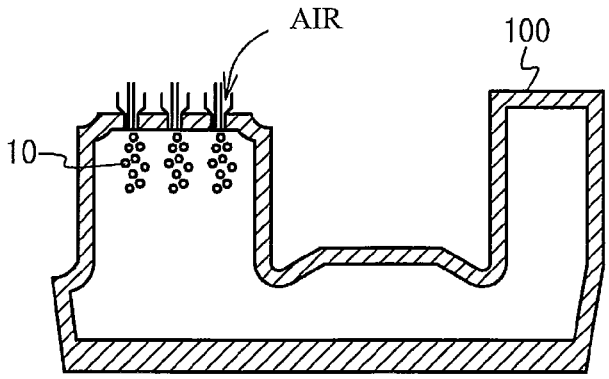
FIG. 1A through FIG. 1E illustrate an embodiment of a copper smelting method.

FIG. 1A through FIG. 1E illustrate an embodiment of a copper smelting method. As illustrated in FIG. 1A, copper matte 10 is charged into a flash converter furnace 100. And, air or oxygen-enriched air is blown into the flash converter furnace 100. The copper matte 10 includes calcium oxide as a flux. Copper grade of the copper matte 10 is not particularly limited, but is preferably approximately 65 weight % to 75 weight %. This is because the copper grade higher than 75 weight % causes reduction of iron concentration of the copper matte and insufficient heat generation, and sufficient amount of slag may not be generated. And, this is because the copper grade lower than 65 weight % causes increasing amount of the slag and economical disadvantage. Heat balance efficiency of the flash converter furnace and the MI furnace may be high within the copper grade range of 65 weight % to 75 weight %.

Figure 1B:
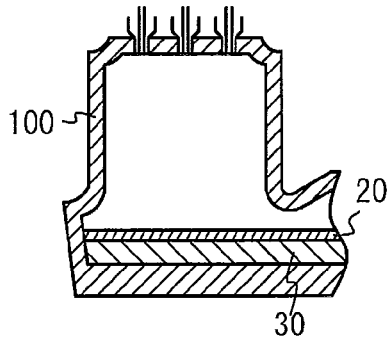

As illustrated in FIG. 1B, calcium ferrite ($FeO_x$—CaO) slag 20 and blister 30 are generated and separated from each other by melt oxidation of the copper matte 10. The copper grade of the calcium ferrite slag 20 is not particularly limited, but is preferably approximately 10 weight % to 25 weight %. This is because the copper grade in the calcium ferrite slag 20 higher than 25 weight % causes increasing of slag volume, increasing of repeating amount of the slag, and economical disadvantage. And, this is because adequate melting slag amount is not obtained and adequate operating condition is not obtained when the copper grade in the calcium ferrite slag 20 is lower than 10 weight %.

Calcium oxide amount of the calcium ferrite slag 20 is not particularly limited, but is preferably approximately 10 weight % to 20 weight %. This is because the weight % range is a relatively favorable melting range of slag and adequate furnace operation is maintained. The copper grade of the blister 30 is not particularly limited, but is preferably approximately 98 weight % or more. This is because slag generation amount is increased in a next refining furnace and process in the refining furnace is difficult. The composition of the calcium ferrite slag 20 and the copper grade of the blister 30 may be controlled with a ratio between oxygen amount blown into the flash converter furnace 100 and matte amount.

Figure 1C:
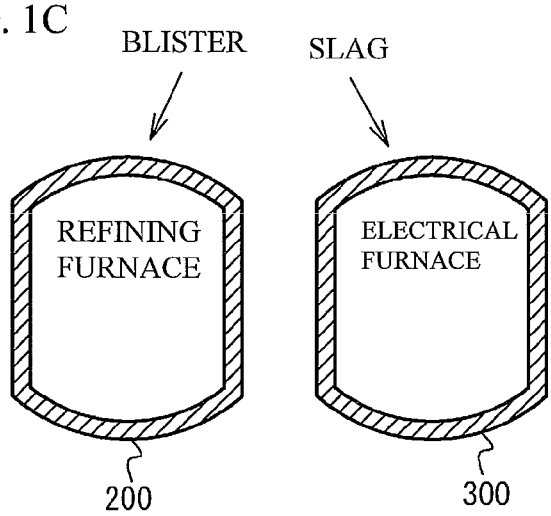

Next, the blister 30 is charged into a referring furnace 200, and the calcium ferrite slag 20 is charged into an electrical furnace 300, as illustrated in FIG. 1C. A resistance heating electrical furnace may be used as the electrical furnace 300. Then, the calcium ferrite slag 20 is heated by providing electrical power to the calcium ferrite slag 20 from an electrode. And reduction degree in the electrical furnace 300 is controlled. In the embodiment, blister is refined from the calcium ferrite slag 20 by controlling oxygen partial pressure $\log PO_2$ in the electrical furnace 300 is equal to −9.3 or less under a temperature condition of 1250 degrees C. to 1350 degrees C. For example, a tap voltage of 90V to 110V is applied to the calcium ferrite slag 20 for approximately four to five hours if the electrical furnace 300 has an inner diameter of 9 meters and has a distance between electrodes of 3.4 meters. The reduction degree in the electrical furnace 300 may be controlled with provision amount of air, coke, iron grain, pig iron grain, or the like.

Here, submergence depth of the electrode is reduced and the solution retention is difficult when the tap voltage was increased, because specific resistance of the calcium ferrite slag is relatively low. And so, it is possible to increase the submergence depth of the electrode at a maximum by controlling the tap voltage to be approximately 90 V within a practical voltage range. It is therefore preferable that the tap voltage is approximately 90 V.

Figure 1D:
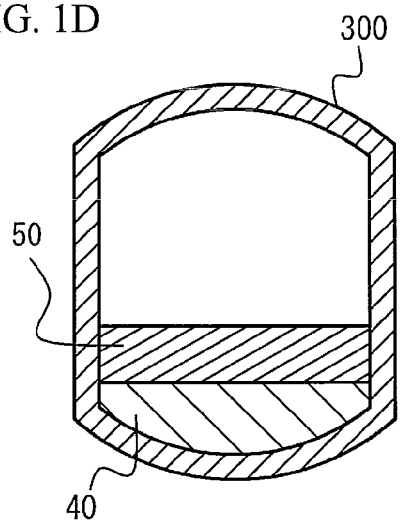

Copper particle settles out and is separated from the calcium ferrite slag 20 by reducing the calcium ferrite slag 20. Therefore, blister 40 is refined from the calcium ferrite slag 20, and slag 50 is generated as illustrated in FIG. 1D. Reducing the calcium ferrite slag 20 causes reduction of impurity (for example, As, Sb, Bi, Ni, Pb) amount of the slag 50. And reducing the calcium ferrite slag 20 causes increasing of Pb amount of the blister 40.

Figure 1E:
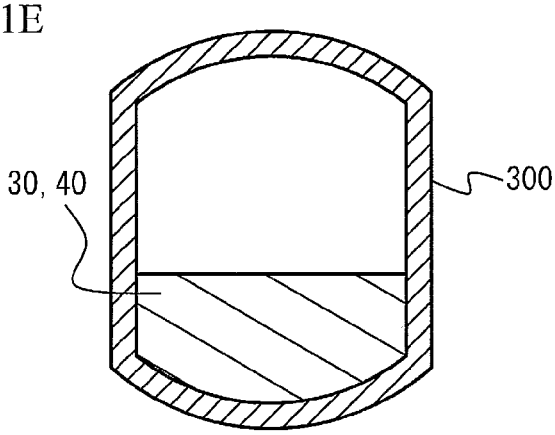

Then, as illustrated in FIG. 1E, the blister 40 is charged into the refining furnace 200. Next, anode is refined from the blister 30 and the blister 40. With the processes, it is possible to obtain the blister copper from the copper matte 10. It is preferable that Pb is charged into the refining furnace in order to coprecipitate Bi included in the blister copper when the anode is electrically refined. However, it may not be necessary to charge Pb into the refining furnace 200, because of high content of Pb in the blister 40.

In accordance with the embodiment, it is possible to reduce the copper grade of the calcium ferrite slag with the reduction process. Here, it may be difficult to melt the calcium ferrite slag with heating if a resistance heating electrical furnace is used, because the calcium ferrite slag has relatively low specific resistance. However, electric conductivity of the calcium ferrite slag may be reduced as the copper grade of the calcium ferrite slag is reduced by the reduction. Therefore, the specific resistance of the calcium ferrite slag may be increased in the electrical furnace. It is therefore possible to reduce the copper grade of the calcium ferrite slag with the resistance heating electrical furnace.

It is possible to reduce the copper grade of the calcium ferrite slag to a desirable value by controlling the reduction degree. For example, it is possible to use the calcium ferrite slag as steel raw material by reducing the copper grade of the calcium ferrite slag to 0.8 weight % or less. And it is possible to increase iron grade of the calcium ferrite slag to 55 weight % or more by controlling the reduction degree. It is therefore possible to improve the quality of the calcium ferrite slag as the steel raw material.

It is possible to use a slag cleaning furnace for silicate (FeOx-SiO2) slag generated in a flash smelting furnace, if the flash smelting furnace is used as the flash converter furnace 100 in accordance with the embodiment. It is therefore possible to perform the copper smelting method in accordance with the embodiment.

Another smelting furnace may be used, although a flash converter furnace is used as a smelting furnace in the embodiment. The MI continuous copper smelting furnace may be used as the smelting furnace in stead of the flash converter furnace. In the embodiment, FIG. 1A and FIG. 1B correspond to a generating step, and FIG. 1D corresponds to a reducing step.

EXAMPLE

Blister copper was obtained with the copper smelting method in accordance with the above-mentioned embodiment.

Example 1

In an example 1, coke was charged into an electrical furnace as a reductant, and calcium ferrite slag was dissolved. Table 1 shows composition ratio of the calcium ferrite slag before being charged into the electrical furnace. The temperature in the electrical furnace was controlled to be 1343 degrees C. Oxygen partial pressure $\log PO_2$ in the electrical furnace was controlled be −9.35 causing reductive atmosphere. The electrical furnace had an inner diameter of 660 mm. Graphite was used as electrodes. A distance between the electrodes was set to be 200 mm. Tap voltage was controlled to be 40V. The calcium ferrite slag had been kept in the electrical furnace for four hours.

[Analysis]

The composition of the calcium ferrite slag after dissolving in the electrical furnace was measured. Table 1 shows the result. The composition of blister after dissolving in the electrical furnace was measured. Table 2 shows the result together with oxygen partial pressure. It is confirmed that atmosphere in the electrical furnace was reductive in the example 1 as shown in Table 2.

TABLE 1

| SLAG COMPOSITION (WEIGHT %) | | | | | | | | | | | | | | |
|---|---|---|---|---|---|---|---|---|---|---|---|---|---|---|
| | Cu | CaO | Fe | $SiO_2$ | $Al_2O_3$ | MgO | Pb | Zn | Ni | As | Sb | Cr | Bi | Cd |
| BEFORE DISSOLVING | 21.9 | 13.3 | 39.6 | 2.5 | 0.45 | 0.15 | 0.90 | 0.46 | 0.11 | 0.44 | 0.039 | 0.01 | 0.028 | 0.01 |
| EXAMPLE 1 | 0.8 | 17.8 | 56.4 | 2.9 | 0.8 | 0.23 | 0.04 | 0.44 | 0.02 | 0.02 | 0.001 | 0.01 | 0.001 | 0.01 |

TABLE 2

| BLISTER COMPOSITION (WEIGHT %) | | | | | | | | | | |
|---|---|---|---|---|---|---|---|---|---|---|
| | $LogPO_2$ | Cu | S | Fe | Pb | Zn | Ni | As | Sb | Bi |
| EXAMPLE 1 | −9.35 | 92.0 | 0.055 | 0.33 | 4.1 | 0.29 | 0.48 | 1.9 | 0.18 | 0.12 |

As shown in Table 1, the copper grade of the calcium ferrite slag was reduced in the example 1. It is therefore confirmed that the copper grade of the calcium ferrite slag is reduced by reduction. And reducing the oxygen partial pressure $logPO_2$ to −9.3 or less causes reduction of the copper grade of the calcium ferrite slag to be 0.8 weight %. It is therefore confirmed that the calcium ferrite slag is usable as steel raw material without repeating of the calcium ferrite slag to the smelting furnace.

As shown in Table 2, it is confirmed that blister copper was obtained from the calcium ferrite slag by reduction process. Pb content was relatively high in the blister copper when coke was doped into the calcium ferrite slag. It is therefore confirmed that Pb charging into the refining furnace is not necessary by controlling the reduction degree.

The present invention is not limited to the specifically disclosed embodiments, but include other embodiments and variations without departing from the scope of the present invention.

The present application is based on Japanese Patent Application No. 2008-227127 filed on Sep. 4, 2008, the entire disclosure of which is hereby incorporated by reference.

What is claimed is:

1. A method of smelting copper comprising:

a generating step of generating blister and calcium ferrite slag from copper matte by charging the copper matte into a smelting furnace and oxidizing the copper matte; and a refining step of refining another blister from the calcium ferrite slag in an electrical furnace under a temperature condition of 1250 degrees C. to 1350 degrees C. and under a reductive atmosphere condition of oxygen partial pressure $logPO_2 \leqq -9.3$, wherein a copper grade of the calcium ferrite slag is reduced to 0.8 weight % or less by controlling a reductive degree in the electrical furnace in the refining step.

2. The method as claimed in claim 1, wherein copper grade of the copper matte before being charged into the smelting furnace is 65 weight % to 75 weight %.

3. The method as claimed in claim 1, wherein the electrical furnace is a resistance heating electrical furnace.

4. The method as claimed in claim 1, wherein the calcium ferrite slag is reduced by charging reductant into the electrical furnace in the refining step.

5. The method as claimed in claim 4, wherein the reductant includes at least one of coke, iron grain, and pig iron grain.

6. The method as claimed in claim 1, wherein the smelting furnace is a flash converter furnace or a continuous copper smelting furnace.

7. The method as claimed in claim 1, wherein a slag cleaning furnace of a flash smelting furnace is used as the electrical furnace.

8. A method of smelting copper comprising:

a generating step of generating blister and calcium ferrite slag, from copper matte by charging the copper matte into a smelting furnace and oxidizing the copper matte; and a refining step of refining another blister from the calcium ferrite slag in an electrical furnace under a temperature condition of 1250 degrees C. to 1350 degrees C. and under a reductive atmosphere condition of oxygen partial pressure $logPO_2 \leqq -9.3$, wherein an iron grade of the calcium ferrite slag is increased to 55 weight % or more by controlling a reductive degree in the electrical furnace, in the refining step.

9. The method as claimed in claim 8, wherein a copper grade of the copper matte before being charged into the smelting furnace is 65 weight % to 75 weight %.

10. The method as claimed in claim 8, wherein the electrical furnace is a resistance heating electrical furnace.

11. The method as claimed in claim 8, wherein the calcium ferrite slag is reduced by charging reductant into the electrical furnace in the refining step.

12. The method as claimed in claim 11, wherein the reductant includes at least one of coke, iron grain, and pig iron grain.

13. The method as claimed in claim 8, wherein the smelting furnace is a flash converter furnace or a continuous copper smelting furnace.

14. The method as claimed in claim 8, wherein a slag cleaning furnace of a flash smelting furnace is used as the electrical furnace.

15. A method of smelting copper comprising:

a generating step of generating blister and calcium ferrite slag from copper matte by charging the copper matte into a smelting furnace and oxidizing the copper matte; and a refining step of refining another blister from the calcium ferrite slag in an electrical furnace under a temperature condition of 1250 degrees C. to 1350 degrees C. and under a reductive atmosphere condition of oxygen partial pressure $logPO_2 \leqq -9.3$, wherein calcium ferrite slag having a copper grade of 10 weight % to 25 weight % and including 10 weight % to 20 weight % calcium oxide is generated in the generating step.

16. The method as claimed in claim 15, wherein a copper grade of the copper matte before being charged into the smelting furnace is 65 weight % to 75 weight %.

17. The method as claimed in claim 15, wherein the electrical furnace is a resistance heating electrical furnace.

18. The method as claimed in claim 15, wherein the calcium ferrite slag is reduced by charging reductant into the electrical furnace in the refining step.

19. The method as claimed in claim 18, wherein the reductant includes at least one of coke, iron grain, and pig iron grain.

20. The method as claimed in claim 15, wherein the smelting furnace is a flash converter furnace or a continuous copper smelting furnace.

* * * * *